US008210394B2

(12) United States Patent
Ma

(10) Patent No.: US 8,210,394 B2
(45) Date of Patent: Jul. 3, 2012

(54) TOY WATER SHOOTER

(75) Inventor: Chor-Ming Ma, Kowloon (CN)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 667 days.

(21) Appl. No.: 12/221,487

(22) Filed: Aug. 4, 2008

(65) Prior Publication Data

US 2009/0258570 A1 Oct. 15, 2009

(30) Foreign Application Priority Data

Apr. 10, 2008 (HK) ..... 08104071.6

(51) Int. Cl.
*A63H 3/18* (2006.01)
*B05B 11/00* (2006.01)

(52) U.S. Cl. ..... 222/79; 222/384

(58) Field of Classification Search ..... 222/79, 222/383.1, 384; 446/473; 273/108.57
See application file for complete search history.

(56) References Cited

U.S. PATENT DOCUMENTS

| | | | | |
|---|---|---|---|---|
| 1,412,973 | A * | 4/1922 | Scruggs | 222/38 |
| 1,723,909 | A * | 8/1929 | Alvey | 222/309 |
| 4,334,383 | A | 6/1982 | Melotti | |
| 4,765,510 | A * | 8/1988 | Rende | 222/79 |
| 5,114,049 | A * | 5/1992 | Knickerbocker | 222/153.01 |
| 5,605,253 | A | 2/1997 | Luk | |
| 5,662,244 | A | 9/1997 | Liu et al. | |

FOREIGN PATENT DOCUMENTS

| | | |
|---|---|---|
| CN | 2166403 Y | 5/1994 |
| CN | 2220055 Y | 2/1996 |
| CN | 2645026 Y | 9/2004 |

* cited by examiner

*Primary Examiner* — Kevin P Shaver
*Assistant Examiner* — Daniel R Shearer
(74) *Attorney, Agent, or Firm* — Alix, Yale & Ristas, LLP

(57) ABSTRACT

A toy water shooter includes a water chamber, a nozzle, a piston movable within the water chamber, a trigger for moving the piston against water in the water chamber for emission via the nozzle, an anchoring mechanism interacting with the trigger and the piston for preventing movement of the piston against water in the water chamber upon initial user-application of force to the trigger.

2 Claims, 4 Drawing Sheets

TOY WATER SHOOTER

BACKGROUND OF THE INVENTION

The present invention relates to toy water shooters. More particularly, although not exclusively, the invention relates to a toy water pistol having a special pulse-firing feature.

A typical inexpensive known toy water pistol 10 is depicted in FIGS. 1 and 2. The water pistol 10 includes a trigger 21 which when squeezed causes firing of a jet of water via nozzle 11. The toy water pistol includes a cylinder 18 in which there is a reciprocal piston 20 connected to the trigger 21. There is a water-tight seal 19 between the piston 20 and the internal wall of cylinder 18. A piston return spring 14 biases the piston 20 and trigger 21 to an extended position. Water from an internal reservoir (not shown) is delivered though a water duct 15 to the cylinder 18 via an inlet valve 17 which is biased into a closed position by an inlet valve spring 16. Water is delivered from the cylinder 18 to the nozzle 11 via an outlet valve 13 which is biased into a closed position by outlet valve spring 12. Upon squeezing of trigger 21, the piston 20 and seal 19 move to pressurize the water within the cylinder 18. This pressure causes the outlet valve 13 to open against the force of spring 12. When the trigger 21 is released, the piston return spring 14 biases the piston 20 and trigger 21 to the rest position whereupon outlet valve 13 closes and inlet valve 17 opens to allow the ingress of water via the water inlet duct 15 to replenish the cylinder 18 with water.

The water-shooting distance will depend upon how rapidly the player squeezes the trigger. For a given nozzle exit hole size, rapid squeezing of the trigger will cause the water jet to fire further, however if the trigger is squeezed slowly, the lower pressure generated inside the cylinder 18 will result in a shorter firing distance.

During squeezing of the trigger 21, the piston 20 tends to pressurize water in the cylinder 18, however as the water jet is concurrently emitted from the nozzle 11, this tends to relieve pressure in the cylinder 18.

The size of the exit hole at nozzle 11 will affect the shooting distance. If the nozzle hole diameter is small, nozzle-induced back-pressure will be high and so the rate of pressure drop in the cylinder 18 will be low—resulting in the water pressure inside the cylinder 18 being maintained at a relatively high level. However the resultant thin water jet will have insufficient momentum to fire a long distance.

On the other hand, if the exit hole at nozzle 11 is large, the water jet can be thicket and thereby have higher momentum to enable shooting over a long distance. A disadvantage however is that the nozzle-induced back-pressure in the cylinder 18 is low and so the rate of pressure drop in the cylinder 18 is high. As a result, a long firing distance cannot be achieved unless the player squeezes the trigger hard and fast.

Usually the players of such known water pistols are young children who cannot squeeze the trigger rapidly or apply the necessary dexterity to fire a good long-distance water jet.

OBJECTS OF THE INVENTION

It is an object of the present invention to overcome or substantially ameliorate at least one of the above disadvantages and/or more generally to provide an improved toy water shooter.

DISCLOSURE OF THE INVENTION

There is disclosed herein a toy water shooter, comprising:

a water chamber;

a nozzle;

a piston movable within the water chamber;

a trigger for moving the piston against water in the water chamber for emission via the nozzle; and an anchoring mechanism interacting with the trigger and the piston for preventing movement of the piston against water in the water chamber upon initial user-application of force to the trigger.

Preferably, the anchoring mechanism is adapted to prevent movement of the piston against water in the water chamber upon user-application of force to the trigger unless said force exceeds a predetermined threshold.

Preferably, the anchoring mechanism comprises a release catch and a friction surface against which the release catch bears, the release catch adapted to deflect from the friction surface to enable movement of the piston upon said threshold being reached.

Preferably, the release catch is attached pivotally to the trigger and wherein the friction surface comprises a ramp fixed with respect to the cylinder.

The toy water shooter can further comprise a resilient spring attached to or formed integrally with the release catch for biasing the release catch into a configuration enabling the release catch to engage with the friction surface.

Preferably, the trigger is movable with respect to the piston and the anchoring mechanism comprises a release catch which restrains the piston, the trigger interacting with the release catch when squeezed to release the piston.

The toy water shooter can further comprise a spring extending between the piston and the trigger which compresses upon squeezing of the trigger prior to set interaction of the trigger with the release catch.

The toy water shooter can further comprise a tube extending from the trigger and from within which the spring extends.

Preferably, the release catch is attached pivotally to the toy water shooter, and the shooter can further comprise a resilient spring biasing the release catch into engagement with the piston.

BRIEF DESCRIPTION OF THE DRAWINGS

Whilst a typical example of a prior art toy water pistol is depicted and described above with reference to FIGS. 1 and 2, preferred forms of the present invention will now be described by way of example with reference to FIGS. 3 to 11 of the accompanying drawings, wherein.

DESCRIPTION OF THE PREFERRED EMBODIMENTS

Figure 1:
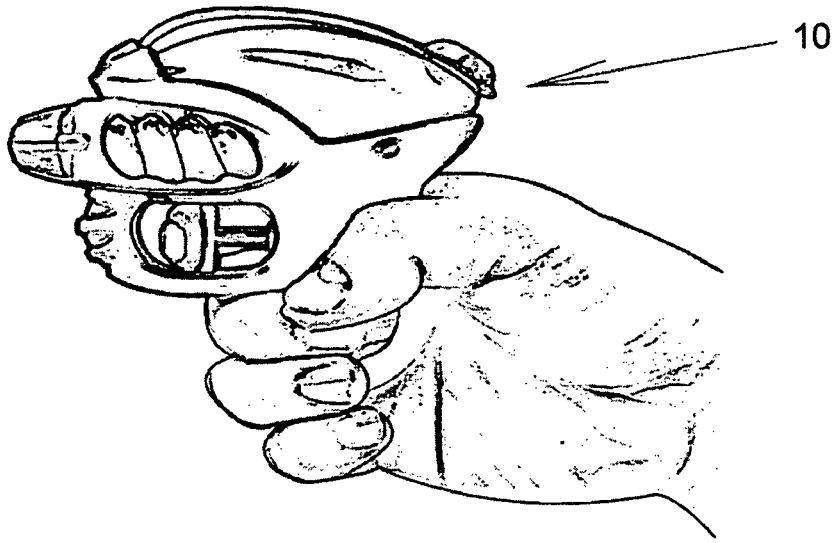
Fig. 1 (PRIOR ART)
Figure 2:
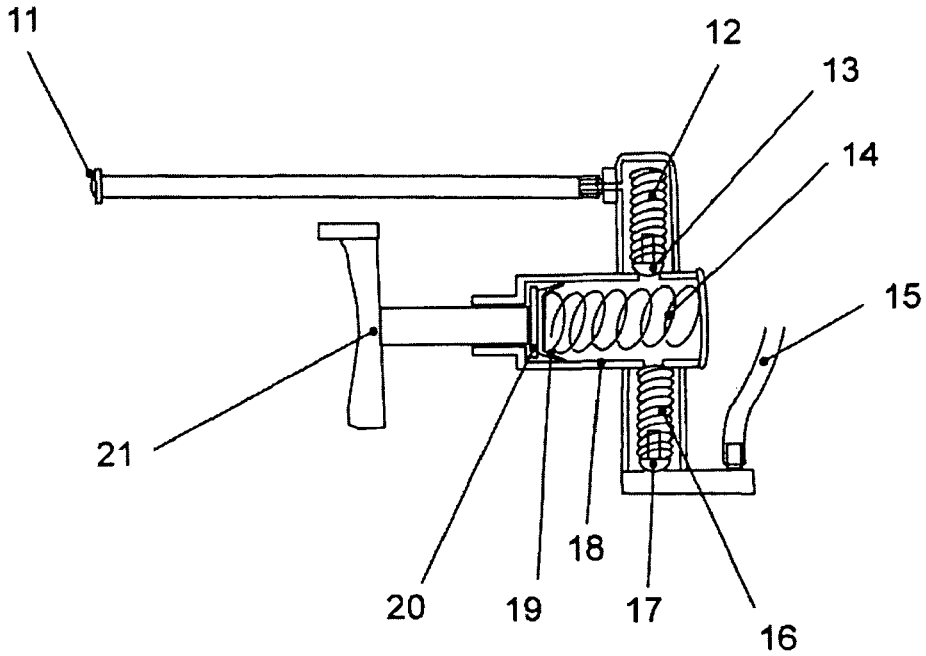
Fig. 2 (PRIOR ART)
Figure 3:
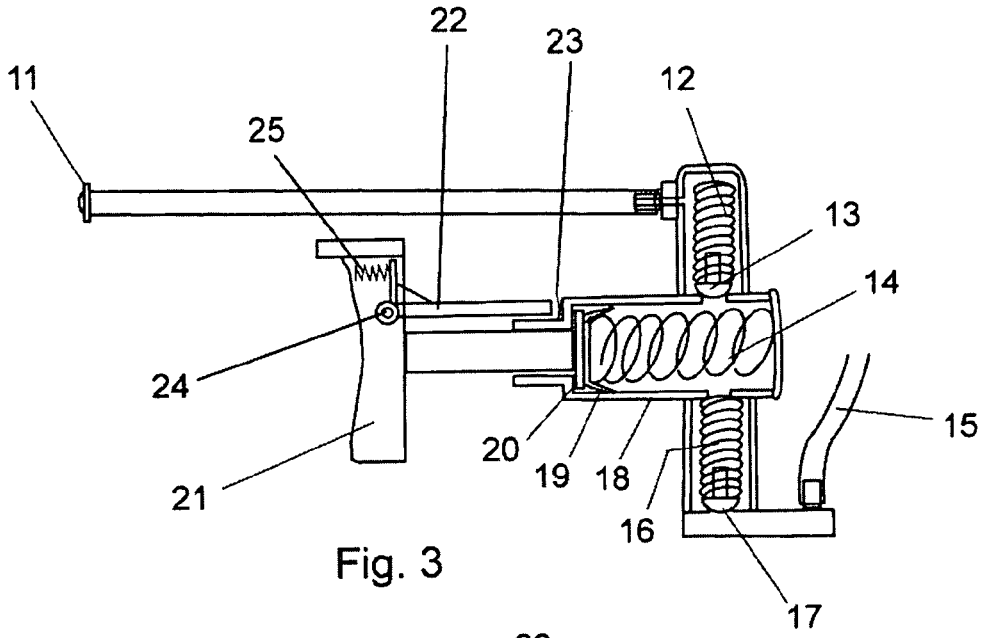
FIG. 3 is a schematic cross-sectional side elevation of the relevant internal components of a toy water shooter prior to squeezing of the trigger.
Figure 4:
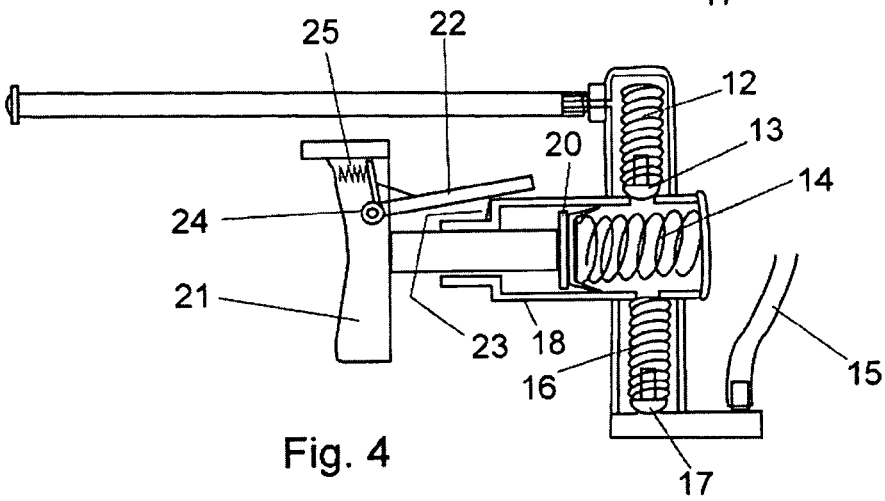
FIG. 4 is a schematic cross-sectional side elevation of the same components depicted in FIG. 3 during squeezing of the trigger.

FIGS. 3 and 4 of the accompanying drawings depict schematically a preferred form of the present invention in which parts common with the prior art water pistol described above with reference to FIG. 2 share the same reference numerals.

New to the embodiment depicted in FIGS. 3 and 4 is a anchoring mechanism which comprises a pivotal release catch 22 attached at pivot 24 to trigger 21, a release catch return coil spring 25 and a ramp surface 23 upon the outer surface of cylinder 18 with which the release catch 22 interacts.

The distal end of release catch 22 bears frictionally against the ramp surface 23 until user-force applied to trigger 21 is sufficient to overcome the frictional engagement between the release catch 22 and ramp surface 23 so that the release catch 22 snap-pivots against the force of return spring 25 and rides up over the ramp surface 23 as shown in FIG. 4 whereupon the trigger 21 and piston 20 pulses rapidly against the piston return spring 14. This quick pulse or "snap" action of the trigger 21 and piston 20 causes a rapid release of water from the nozzle 11 which would be sized in the "large" category described above with reference to the prior art. As a result, a relatively thick, high-inertia water jet impulse is emitted from the nozzle 11.

Upon release of trigger 21, the piston return spring 14 acts in the same manner as described above to return the trigger 21 to its rest position. As the piston returns to its rest position, the distal end of release catch 22 returns by action of release catch return spring 25 to its rest position as depicted in FIG. 3.

Figure 5:
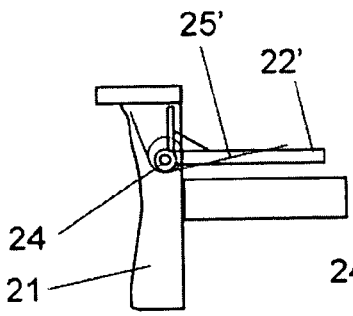
FIGS. 5, 6 and 7 are schematic side elevations of alternative anchoring mechanisms which might substitute for that shown in FIGS. 3 and 4.
Figure 6:
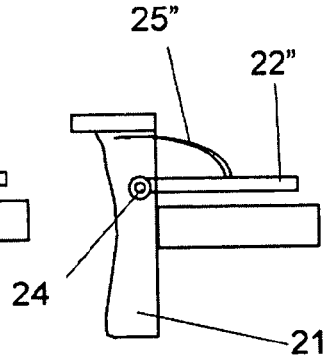
Figure 7:
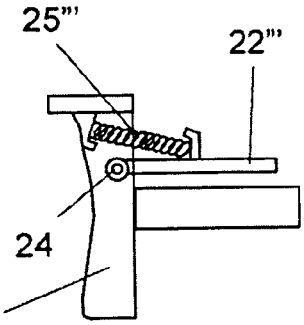
Figure 8:
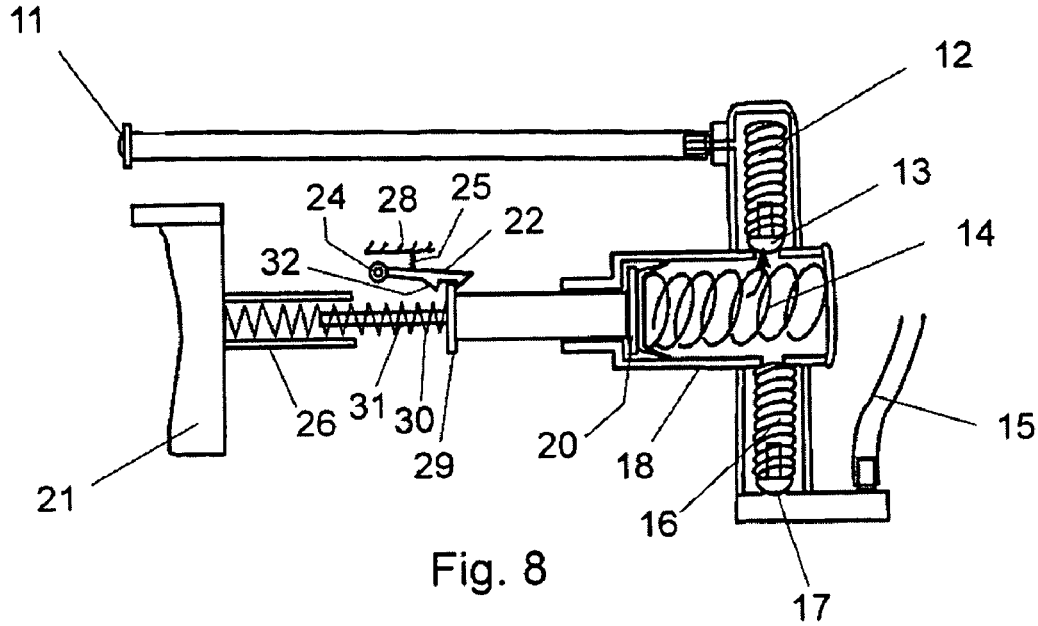
FIG. 8 is a schematic cross-sectional side elevation of the relevant internal components of an alternative toy water shooter prior to squeezing of the trigger.

Alternative anchoring mechanisms are depicted in FIGS. 5, 6 and 7. The mechanism depicted in FIG. 5 comprises a release catch 22' much the same as that depicted in FIGS. 3 and 4, but instead of a coil spring 25, there is a torsion spring 25' fitted about the pivot 24. The mechanism depicted in FIG. 6 comprises a release catch 22" having extending from it a resilient plastic spring finger 25" which bears against the trigger 21 to bias the release catch 22" into the rest position. The mechanism depicted in FIG. 7 includes a release catch 22''' having a mid-location spring seat and a compression coil spring 25''' extending between the spring seat and an opposing spring seat on the trigger 21.

An alternative embodiment is depicted in FIGS. 8 to 11. This embodiment allows the trigger to be partially depressed prior to release of the piston. In this embodiment, the trigger 21 is movable with respect to the piston 20. A compression coil spring 30 extends between the trigger 21 and the piston 20. The spring 30 has one of its ends housed within a tube 26 that extends toward the piston from the back of trigger 21. A rod 31 extends from the piston 20 toward the trigger 21. The rod 31 extends into one end of the spring 30.

The piston 20 is provided with a latching flange 29 with which a release catch 22 interacts. The release catch 22 is attached pivotally at 24 to a fixed part 28 of the water pistol body. A light return spring 25 biases the release catch 22 into engagement with the latching flange 29 and retains the piston against forward movement as the trigger 21 is squeezed throughout part of its travel.

Figure 9:
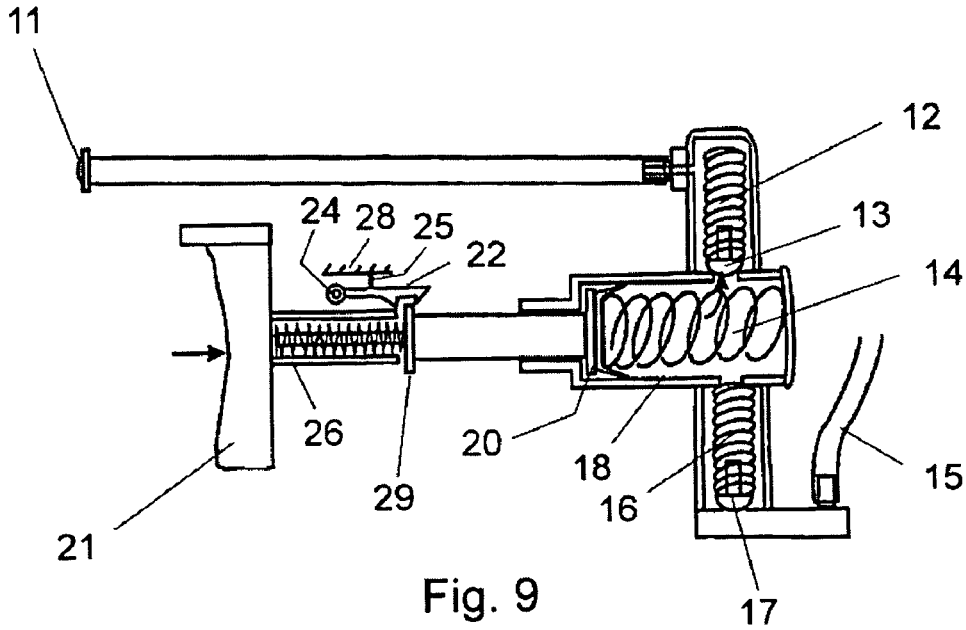
FIG. 9 is a schematic cross-sectional side elevation of the parts shown in FIG. 8 during squeezing of the trigger as the piston is just about to be released.
Figure 10:
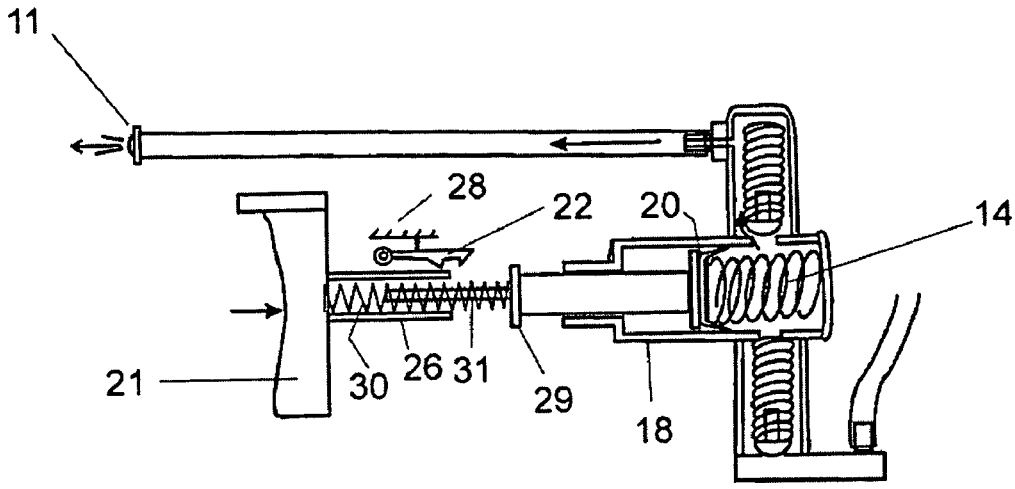
FIG. 10 is a schematic cross-sectional side elevation of the parts shown in FIGS. 8 and 9 after release of the piston.
Figure 11:
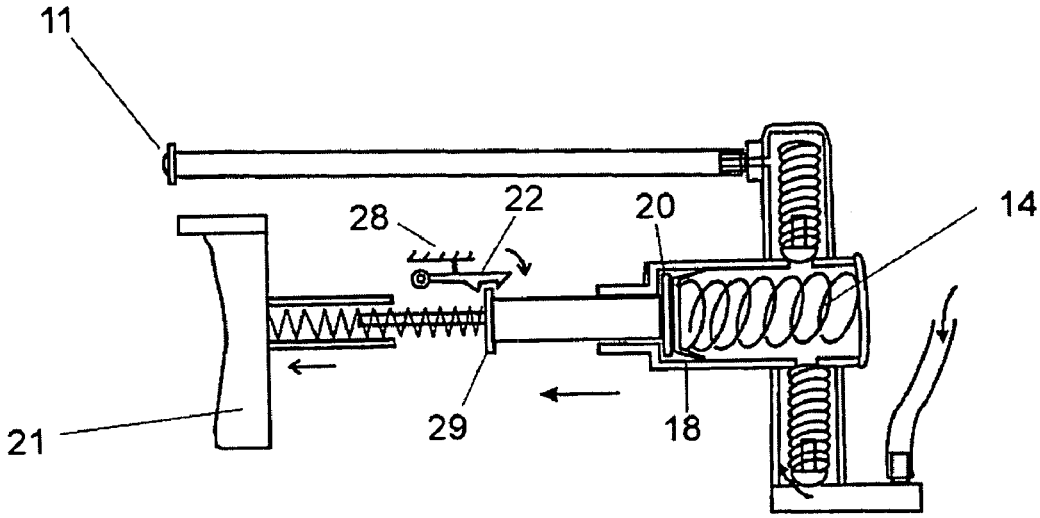
FIG. 11 is a schematic cross-sectional side elevation of the parts shown in FIGS. 8 to 11 during return of the trigger to its rest position after squeezing.

The release catch 22 includes a ramp surface 32 against which tube 26 bears as the trigger 21 is squeezed as shown in FIG. 9. This interaction causes the release catch 22 to disengage from the latching flange 29 so that the energy of compressed spring 30 causes the piston 20 to release and move rapidly forward as shown in FIG. 10 against the water within the cylinder 18. It should be noted here that spring 30 has a higher spring force than return spring 14.

Upon release of the trigger, spring 30 extends and when fully extended the return spring 14 pushes the piston 20 back into position whereupon latching flange 28 engages with and is retained in place by catch 22.

It should be appreciated that modifications and alterations obvious to those skilled in the art are not be considered as beyond the scope of the present invention. For example in the embodiment of FIGS. 3 to 7, rather than attaching the release catch to the trigger, it could instead be attached to a fixed part within the toy gun body in which case the ramp surface would be provided on the trigger. Furthermore, instead of a pivotal release catch, the release catch could be integrally moulded with the trigger (or other fixed part within the toy gun body) and adapted to elastically deflect upon interaction with a ramp surface or other friction surface.

The invention claimed is:

1. A toy water shooter, comprising:

a cylindrical housing defining a water chamber;

a nozzle;

a piston movable within the water chamber;

a trigger for moving the piston against water in the water chamber for emission via the nozzle; and an anchoring mechanism pivotally attached to the trigger for preventing movement of the piston against water in the water chamber upon initial user-application of force to the trigger unless the force exceeds a predetermined threshold wherein movement of said piston is enabled, and wherein the anchoring mechanism comprises a release catch attached pivotally to the trigger and a friction surface against which the release catch bears, the release catch adapted to deflect from the friction surface to enable movement of the piston upon said threshold being reached, said friction surface comprising a ramp on the outer surface of the cylindrical housing.

2. The toy water shooter of claim 1, further comprising a resilient spring attached to or formed integrally with the release catch for biasing the release catch into a configuration enabling the release catch to engage with the friction surface.

* * * * *